US011156127B2

(12) United States Patent
Albers et al.

(10) Patent No.: US 11,156,127 B2
(45) Date of Patent: Oct. 26, 2021

(54) POSITIONING ELEMENT WITH RECESSES FOR A GUIDE VANE ARRANGEMENT

(71) Applicant: MTU Aero Engines AG, Munich (DE)

(72) Inventors: Lothar Albers, Munich (DE); Alexander Boeck, Kottgeisering (DE)

(73) Assignee: MTU Aero Engines AG, Munich (DE)

( * ) Notice: Subject to any disclaimer, the term of this patent is extended or adjusted under 35 U.S.C. 154(b) by 343 days.

(21) Appl. No.: 15/682,246

(22) Filed: Aug. 21, 2017

(65) Prior Publication Data

US 2018/0058263 A1 Mar. 1, 2018

(30) Foreign Application Priority Data

Aug. 23, 2016 (DE) ..... 10 2016 215 784.1

(51) Int. Cl.
*F01D 25/24* (2006.01)
*F01D 9/04* (2006.01)
*F01D 5/30* (2006.01)

(52) U.S. Cl.
CPC ..... *F01D 25/246* (2013.01); *F01D 5/303* (2013.01); *F01D 9/041* (2013.01); *F01D 9/042* (2013.01); *F05D 2230/644* (2013.01); *F05D 2240/14* (2013.01); *F05D 2250/141* (2013.01); *F05D 2260/941* (2013.01)

(58) Field of Classification Search
CPC ..... F01D 25/246; F01D 9/00; F01D 9/041; F01D 9/042
See application file for complete search history.

(56) References Cited

U.S. PATENT DOCUMENTS 2,724,544 A * 11/1955 Hardigg ..... F01D 9/04 415/209.4
3,056,582 A 10/1962 Rowe et al.
4,076,451 A * 2/1978 Jankot ..... F01D 5/284 415/200
4,365,933 A * 12/1982 Langer ..... F01D 9/041 415/200
7,097,422 B2 * 8/2006 Rice ..... B23H 9/10 415/134
7,229,245 B2 * 6/2007 Ellis ..... F01D 9/041 415/135

(Continued)

FOREIGN PATENT DOCUMENTS

DE 2848747 A1 5/1980
WO 2011157549 A1 12/2011

*Primary Examiner* — Michael L Sehn
(74) *Attorney, Agent, or Firm* — Barlow, Josephs & Holmes, Ltd.; David R. Josephs

(57) ABSTRACT

The invention relates to a positioning element for a guide vane arrangement of a guide vane stage of a gas turbine, with at least one base section curved in the peripheral direction; a plurality of uptake openings arranged next to each other in the peripheral direction on the base section, whose aperture axis runs substantially in the radial direction and which are designed to take up a respective radially inner guide vane section; a coupling section provided on the base section, which is or can be coupled to a seal carrier of a seal arrangement. According to the invention, it is proposed that at least one recess is provided in the base section, which is arranged between two neighboring uptake openings and runs from inside to outside at least in the radial direction.

11 Claims, 5 Drawing Sheets

(56) References Cited

U.S. PATENT DOCUMENTS

| | | | | |
|---|---|---|---|---|
| 8,075,265 | B2 * | 12/2011 | Turzig | F01D 9/042 415/209.3 |
| 2007/0128020 | A1 | 6/2007 | Dervaux et al. | |
| 2011/0110783 | A1 | 5/2011 | Addis et al. | |
| 2011/0189008 | A1 | 8/2011 | Brunt et al. | |
| 2012/0282088 | A1 | 11/2012 | Stiehler | |
| 2014/0140822 | A1 * | 5/2014 | Capozzi | F01D 9/00 415/160 |
| 2015/0132124 | A1 * | 5/2015 | Albers | F01D 9/042 415/209.3 |
| 2016/0003073 | A1 | 1/2016 | Derclaye | |

* cited by examiner

POSITIONING ELEMENT WITH RECESSES FOR A GUIDE VANE ARRANGEMENT

BACKGROUND OF THE INVENTION

The present invention relates to a positioning element for a guide vane arrangement of a guide vane stage of a gas turbine, with at least one base section curved in the peripheral direction; a plurality of uptake openings that are arranged next to each other in the peripheral direction on the base section and whose aperture axis runs substantially in the radial direction and that are designed to accommodate a respective radially inner guide vane section; a coupling section provided on the base section, which is coupled or can be coupled to a seal carrier of a seal arrangement.

Directional indications such as "axially" or "axial" and "radially" or "radial" and "peripheral" should basically be understood as referring to the machine axis of the gas turbine, unless otherwise indicated explicitly or implicitly from the context. Such a guide vane stage may be arranged in the region of a compressor or in the region of the turbine. The feature of a coupling section should be construed broadly and comprises, for example, a section enabling a form-fitting connection with a mating piece of a seal carrier. Yet the coupling section can also be simply a region or a face of the base section on which a sealing element can be arranged directly.

Such a positioning element can also be called a positioning ring or positioning half-ring. As a rule, the circular arrangement in a gas turbine is accomplished by two semicircular positioning half-rings, which abut against one another in a common parting plane. It has been found that because of the thermal relations a radial temperature gradient forms in the positioning half-rings, wherein the positioning half-rings are subject to a greater strain radially outside than radially inside in the peripheral direction. This greater radially outside peripheral strain leads in particular to strong deformations of the positioning element also in the region of the parting plane, and of the seal carrier coupled to it. These deformations may also be described as constrictions and are known under the concept of the cording effect. This has the consequence, in particular, that the seal carrier or its sealing elements come into contact with sealing fins rotating relative to them, so that strong wear and tear occurs on the sealing elements. The cording effect in the region of the parting plane, in particular, leads to a narrowing or local reduction in the diameter when the gas turbine is accelerated, and to a widening or local increase in the diameter when the gas turbine is decelerated.

SUMMARY OF THE INVENTION

The object of the invention is to provide a positioning element in which the cording effect is lessened.

For this, it is proposed that at least one recess is provided in the base section, which is arranged between two neighboring uptake openings and runs from inside to outside at least in the radial direction. The providing of such recesses makes it possible for the positioning element to have a shorter effective radial height in the region of the recess, which is acted upon by the temperature gradient, and which exerts an influence on the strain in the positioning element. When such recesses are provided at several places along the periphery between respective uptake openings, the cording effect can be influenced, since the deformations occurring are less than in the case of a continuous positioning element without recesses. The recesses in the positioning element also lead to a reduced bending stiffness of the positioning element. Besides the thermal effects, the cording effect is also influenced by the ratio of the bending stiffnesses of positioning element and seal carrier. It is advantageous in this case for the positioning element to be "softer" or less stiff, because then the cording effect is less. Moreover, with a less bending-stiff positioning element, a stiffer seal carrier can counteract the constriction of the positioning element.

The positioning element can be formed as a ring and have two semicircular base sections.

A reduction of the cording effect and thus of constrictions at the positioning element also leads to a reduction of local inflows at a parting plane of the semicircularly shaped base sections. Due to fewer constrictions, the formation of gaps and leaks can also be avoided, which has a positive impact on the efficiency and the surge limit, especially because leaks at the sealing elements can be reduced.

Moreover, thanks to the smaller inflows, a lower load on the sealing elements can also be achieved, especially at rotor sealing fins and their coating. This leads to an improved or longer durability, so that the maintenance and repair effort and expense can be reduced.

The coupling section may comprise at least one axially front groove and one axially rear groove, which run on the base section along the peripheral direction. The two encircling grooves serve, in particular, for coupling a seal carrier to the positioning element.

According to a first embodiment, the axially front groove and the axially rear groove may have substantially the same distance in the radial direction from a radially inner side of the base section. In other words, the two grooves lie at roughly the same level or have substantially the same distance (radius) from a machine axis.

In the first embodiment, moreover, the recess may run in the axial direction between two uptake openings and extend from an axially front face of the base section to an axially rear face of the base section. The recess may be formed as a slot in the base section.

Moreover, in the first embodiment, the recess may have a varying radial height or a uniform height along the axial direction. Furthermore, the recess may have a varying width along the axial direction in the peripheral direction or it may have a uniform width. Thanks to an appropriate design or dimensioning of the recesses or of the slot, the cording effect can be influenced in a targeted manner, in particular when considering the fact that the radial temperature gradient also changes over the axial length.

According to a second embodiment the recess may run in peripheral direction in an axially rear region of the base section, so that, from the axial rear, substantially cylindrical outer walls of the uptake openings are visible. The recess may be bounded in the axial direction by an axially front wall section in this case. Thus, there is a continuous recess in an axially rear region, which extends to the front in the axial direction between the uptake openings and ends at the axially front wall section.

In the second embodiment, the axially front groove and the axially rear groove may have a different distance from a radially inner side of the base section.

The positioning element of the second embodiment can be produced by an additive manufacturing process, especially by selective laser melting.

The invention further relates to a seal carrier for a seal arrangement with a bottom section curved in the peripheral direction, on which there is provided a sealing element radially inside; a mating coupling section which is coupled or can be coupled to a coupling section of a positioning element radially inside, wherein the mating coupling section has an axially front spring section and an axially rear spring section, which are introduced or can be introduced with corresponding grooves of the coupling section of the positioning element. It is proposed here that the axially front spring section and the axially rear spring section have a different distance from a radial inner side of the bottom section. Such a seal carrier is especially suited for coupling with a positioning element of the second embodiment.

The spring sections may be arranged at an axially front carrier wall and at an axially rear carrier wall, in such a way that the two spring sections face each other in the axial direction.

The bottom section can have, radially outside, a cover section which is inclined with respect to the axial direction and the radial direction. Such an inclined cover section serves, in particular, for covering the recess in a coupled state on the positioning element.

In the bottom section, especially in its cover section, a plurality of openings can be provided next to each other in the peripheral direction.

Finally, the invention also relates to a guide vane carrier arrangement for a gas turbine, especially an aircraft gas turbine, with at least one positioning element according to the first embodiment and at least one corresponding seal carrier or with at least one positioning element according to the second embodiment and at least one above-described seal carrier.

BRIEF DESCRIPTION OF THE DRAWING FIGURES

The invention shall be described by way of an example and not in limiting fashion with reference to the appended figures.

FIG. 6A shows a variant with variable radial height of the recess, and FIG. 6B shows a variant with uniform radial height of the recess, corresponding to the example of FIGS. 1 to 4.

DESCRIPTION OF THE INVENTION

Figure 1:
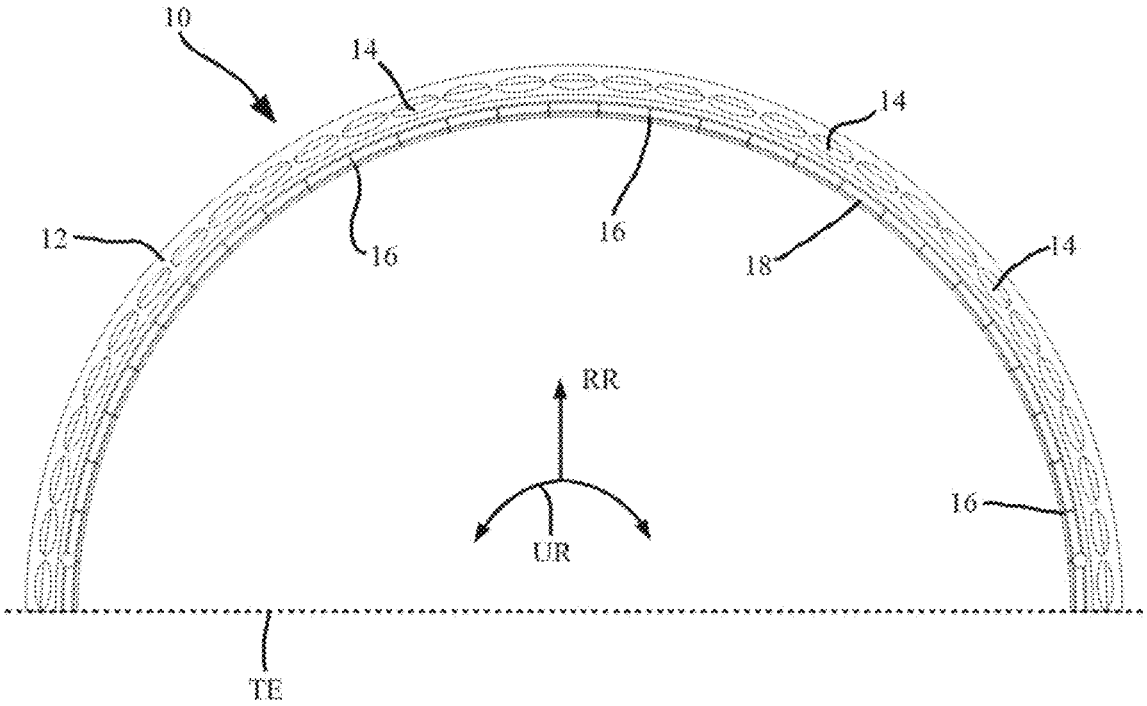
FIG. 1 shows in a schematic representation a top view of an axial front face of a positioning element according to a first embodiment.
Figure 2:
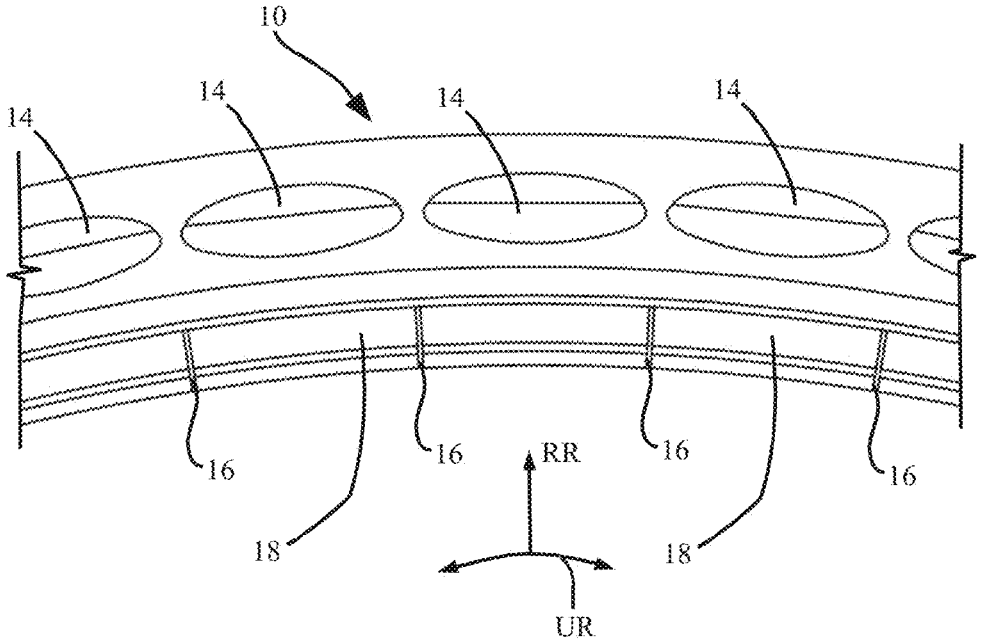
FIG. 2 shows in a schematic perspective view from the axially front side a portion of the positioning element according to the first embodiment.

FIG. 1 shows in a simplified schematic top view in the axial direction a first embodiment of a positioning element 10 and FIG. 2 shows a magnified section of the positioning element 10. As is evident from these figures, the positioning element 10 comprises a base section 12, which his curved in a semicircle. In the base section 12 there are provided a plurality of uptake openings 14 arranged next to one another in the peripheral direction UR. The uptake openings 14 serve in particular to accommodate guide vanes, not shown here. Respective recesses 16 are visible in the peripheral direction UR between two neighboring uptake openings 14. These recesses 16 extend in the radial direction RR from the inside to the outside. In the region of the broken line TE (FIG. 1) the so-called parting plane is indicated. In the region of this parting plane, two semicircular base sections 12 lie against one another, so that a complete circular positioning element 10 can be formed. The base section 12 moreover comprises a coupling section 18 located radially inside. On this coupling section 18 it is possible to secure a seal carrier, not shown here. The recesses 16 extend in this first embodiment especially through the coupling section 18. As already mentioned in the beginning, the feature of the coupling section can be construed broadly and encompasses for example a section which enables a form-fitting connection with a mating part of a seal carrier. But the coupling section can also be simply a region or a face of the base section on which a sealing element can be arranged directly.

Figure 3:
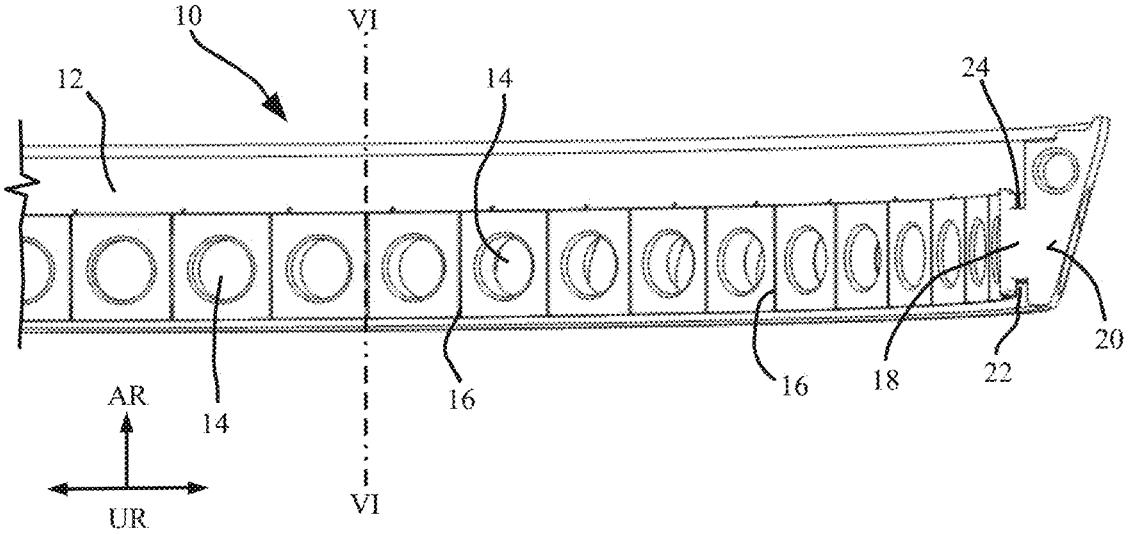
FIG. 3 shows in a schematic perspective view from the radially inner side roughly half of the positioning element of FIG. 1.
Figure 4:
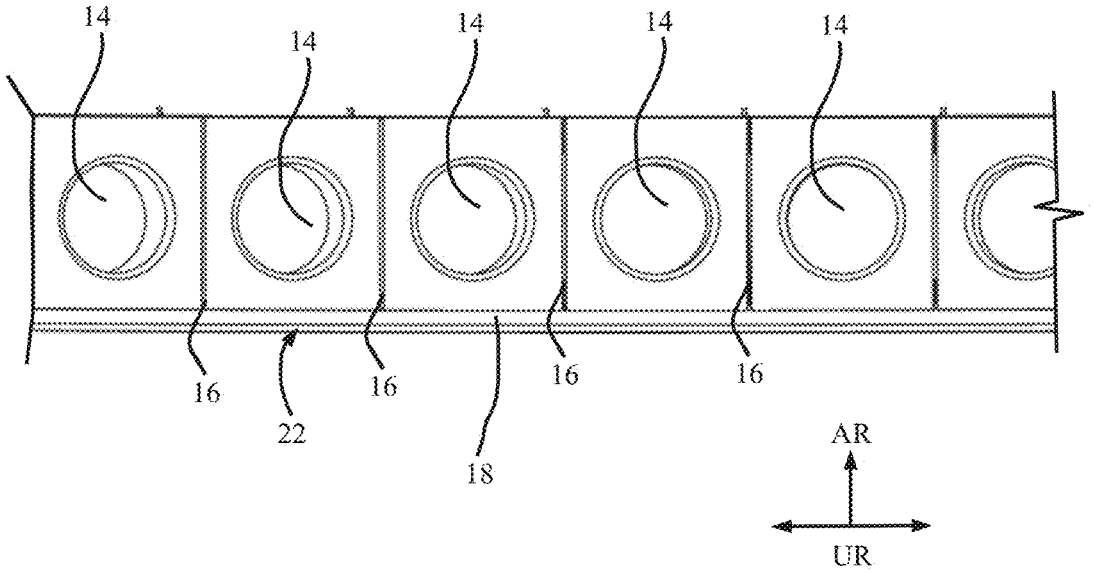
FIG. 4 shows in a schematic perspective view from the radially inner side a magnified portion of the positioning element of FIG. 3.

FIGS. 3 and 4 show the positioning element 10, which in technical jargon is also known as a locating ring or positioning ring, in a perspective representation radially inside. In particular, one can see in FIG. 3 an abutting face 20 of the base section 12. By this abutting face 20, the base section 12 lies in the region of the parting plane TE (FIG. 1) against the other semicircular base section. Moreover, it can be seen from this representation that the coupling section 18 has a kind of inverted T profile. In this way, an axially front groove 22 and an axially rear groove 24 are formed. These two grooves 22, 24 are to be connected with corresponding mating pieces or springlike mating coupling sections of a seal carrier. The recesses 16 also extend in particular through the grooves 22, 24.

Figure 5:
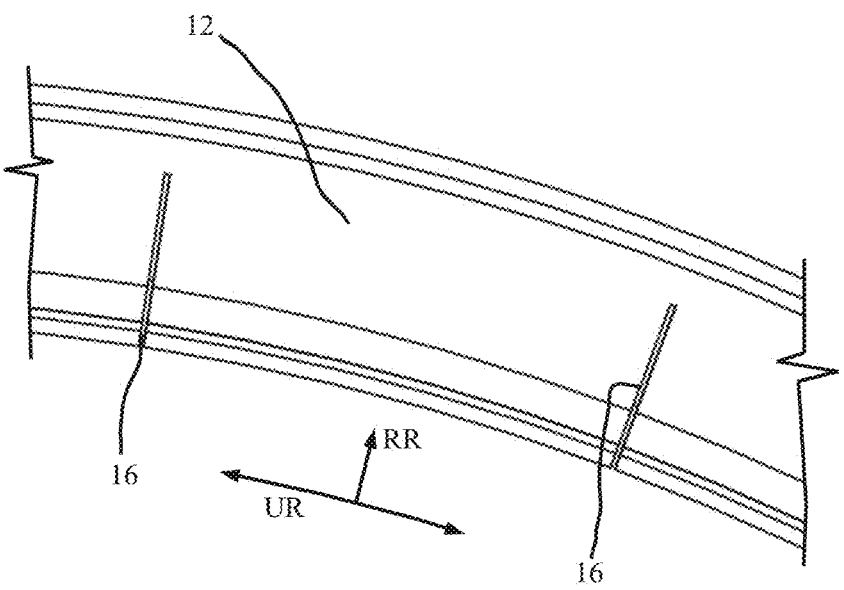
FIG. 5 shows a magnified perspective representation of the positioning element from the axial rear.

Whereas a recess 18 is arranged between every two neighboring uptake openings 14 in FIGS. 1 to 4, FIG. 5 shows schematically and simplified a variant in which one recess 16 is provided only every two uptake openings 14. FIG. 5 is a view from axial rear of the base section 12. From this representation and also from the preceding representations it can be seen that the recesses 16 extend from the radial inside to the radial outside. However, the recesses 16 do not cut through the base section 12. Instead, the recesses 16 are in the form of slots. The width in the peripheral direction of such a recess 16 may be uniform or variable along the axial direction or/and along the radial direction.

Figure 6A:
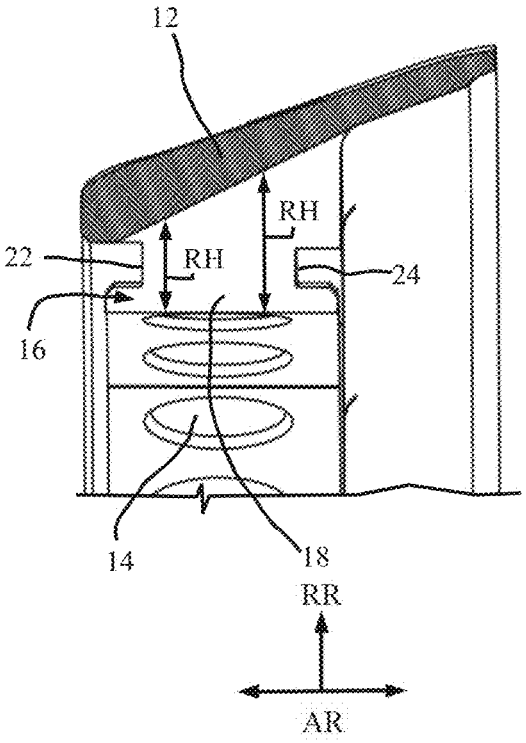
FIGS. 6A and 6B shows in partial figures respective cross sections of the positioning element, corresponding roughly to the sectioning line VI-VI of FIG. 3, where
Figure 6B:
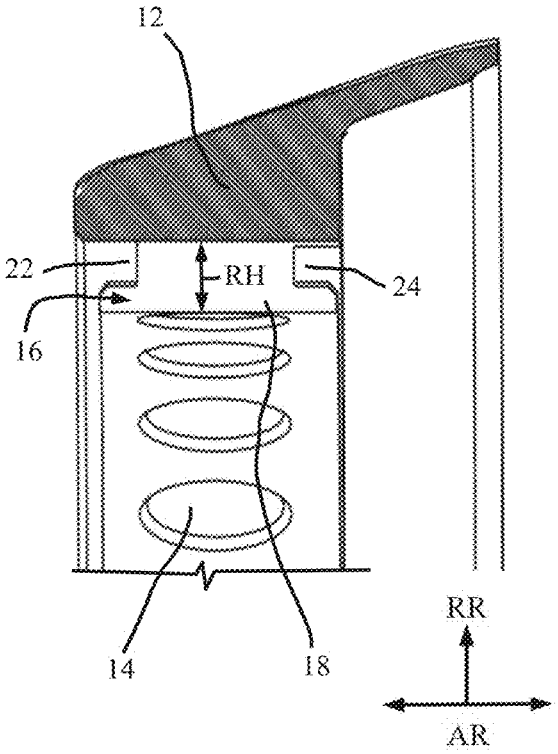

FIGS. 6A and 6B are cross section representations in the region of a recess 16 or slot, as indicated by the sectioning line VI-VI of FIG. 3. A radial height RH of the recesses 16 can likewise be uniform or variable, as is evident from the cross section representations of FIGS. 6A and 6B. In FIG. 6A a variable height RH of the recess 16 or the slot is shown. In FIG. 6B a uniform height RH over the axial extension is shown.

It becomes clear from the variants of FIGS. 6A and 6B as well as the rest of the specification regarding the possible adaptation of the width of the recesses that the recesses can be adapted by altering their dimensions in height and width to respective properties, especially the radial temperature gradients. Such temperature gradients also depend in particular on other boundary conditions of the design of an inner ring and guide vane arrangement of a gas turbine.

Figure 7A:
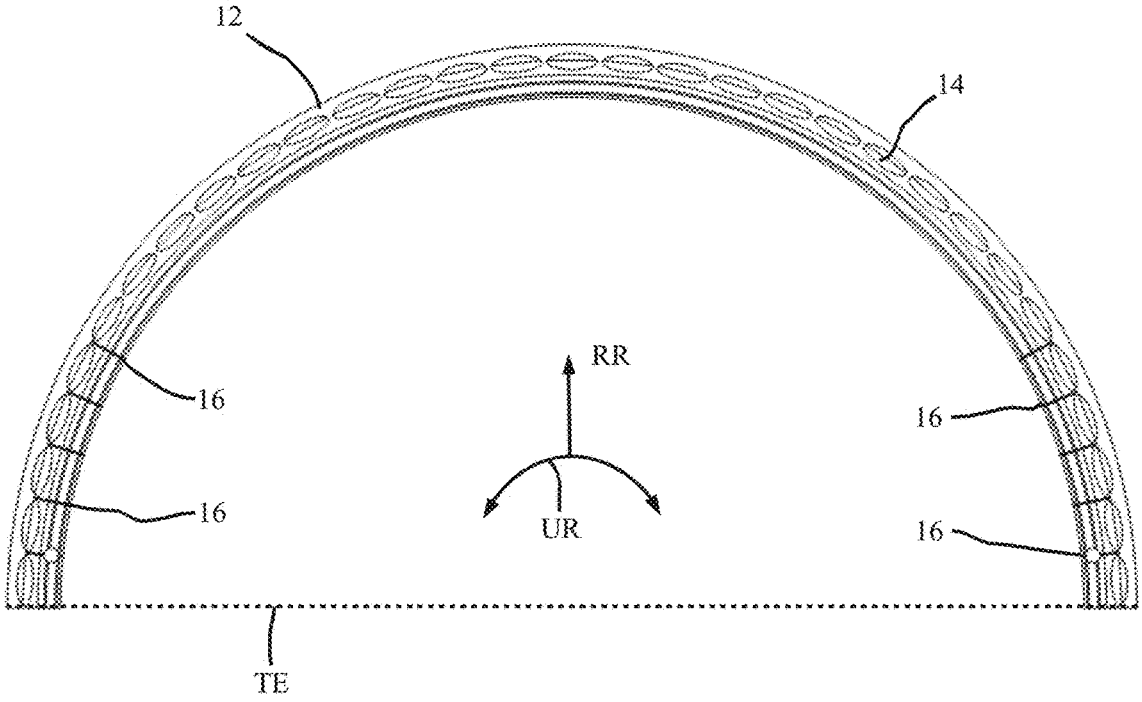
FIGS. 7A and 7B shows in the partial figures variants of the positioning element of the first embodiment in a representation similar to FIG. 1.
Figure 7B:
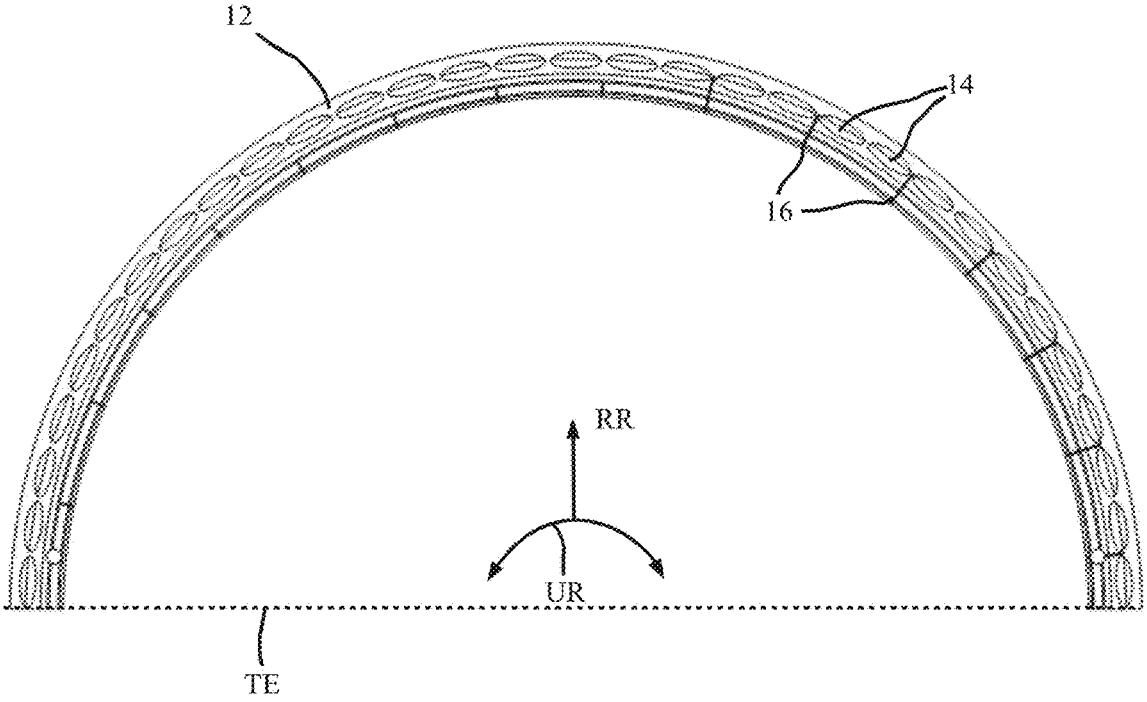

FIGS. 7A and 7B shows in the partial figures two variants of a base section 12. The base section 12 in FIG. 7A each time has a plurality of recesses 16, here five of them, starting from the parting plane TE. Thus, the recesses are not distributed along the circumference of the entire base section 12, but only near the parting plane TE.

In the base section 12 of FIG. 7B, recesses 16 are provided along the entire circumference, but one recess 16 is provided only every two uptake openings 14. FIG. 7B in this regard corresponds to FIG. 5.

It is evident from FIGS. 7A and 7B that the recesses 16 may be provided at different distances from each other and partially or entirely along the circumference of the base section 12. This likewise shows that the number and arrangement of the recesses 16 can be chosen in accordance with the boundary conditions, such as the radial temperature gradient and/or stiffness of the positioning element or seal carrier, so that the cording effect can be kept as low as possible depending on the design of the gas turbine.

Figure 8:
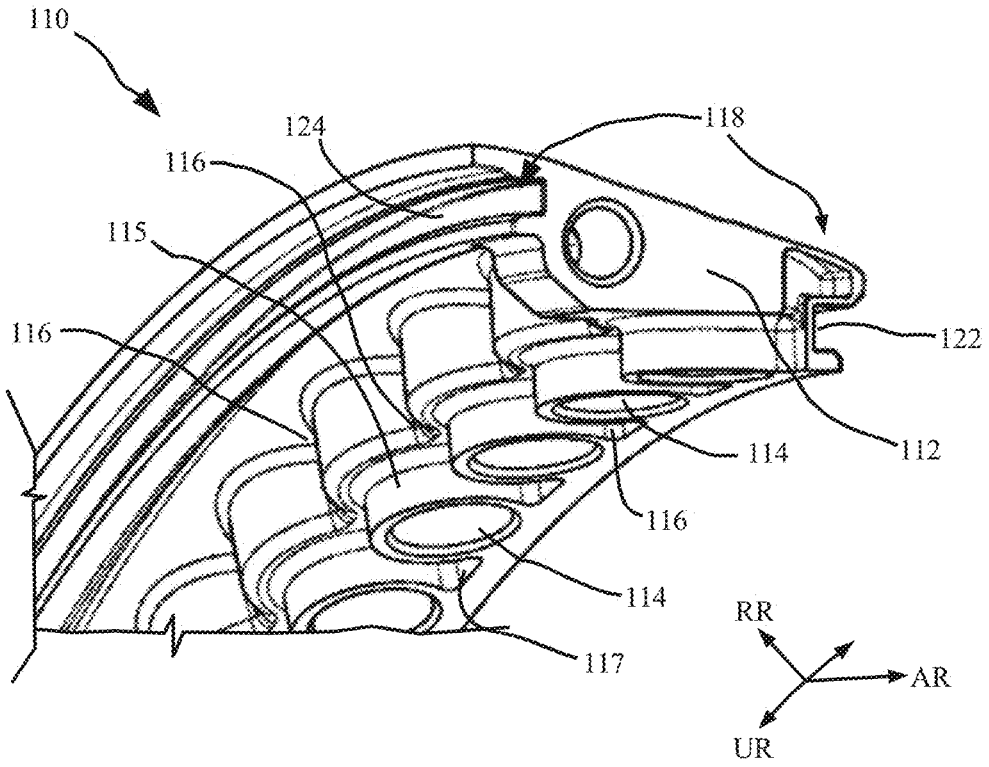
FIG. 8 shows in a schematic perspective view from the axial rear, at a slant, a portion of a positioning element of a second embodiment.

FIG. 8 shows a second embodiment of a positioning element 110 with a base section 112 in a perspective view from the rear at a slant (axial direction). Respective recesses 116 are provided between uptake openings 114, extending at least in the radial direction RR. Contrary to the recesses 16 of the first embodiment (FIG. 1-7), the recesses 116 are not designed as slots, but instead are fashioned so that the outer peripheral walls 115 of the uptake openings 114 are visible.

The base section likewise has a coupling section 118, comprising an axially front groove 122 and an axially rear groove 124. Contrary to the first embodiment, the axially rear groove 124 is arranged radially outside on the base section 112. This altered arrangement of the axially rear groove 124 is due to the larger recesses 116 and lack of material radially inside where an axially rear groove could be formed as in the first embodiment. The axially rear groove 124 is located further radially outward in regard to the machine axis of the gas turbine than the axially front groove 122. The recesses 116 are bounded at the axial front side by an axially front wall section 117. The axially front wall section 117 here also forms the rear side or facing away side of a bottom of the axially front groove 122.

The configuration shown here for the base section 112 with the recesses 116 and the coupling section 118 with the two grooves 122, 124 is optimized in that the base section 112 can be produced by an additive manufacturing process, especially by selective laser melting. The semicircular base section 112 for example can be constructed layer by layer from axial front to axial rear.

Figure 9:
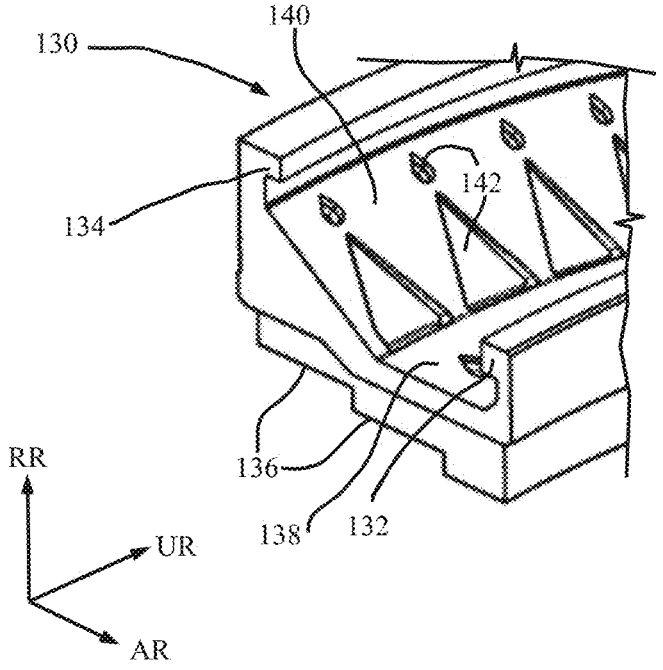
FIG. 9 shows in a schematic perspective view from the axial front, at a slant, a portion of a seal carrier which can be coupled with the positioning element of FIG. 8.

Due to the altered design of the base section 112, FIG. 9 shows part of a seal carrier 130 adapted to this design. The seal carrier 130 comprises mating coupling sections 132, 134. The mating coupling sections 132, 134 project in the axial direction, such that spring-like protrusions are formed. Accordingly, the mating coupling section 132 can engage in the axially front groove 122 of the base section, and the mating coupling section 134 can engage in the axially rear groove 124 of the base section 112. A sealing element, not shown here, would be provided on the radially inner side 136 of the seal carrier 130. The mating coupling sections 132, 134 are designed as an axially front spring section 132 and an axially rear spring section 134. In particular, they have a different distance from a radially inner side of a bottom section 138.

The seal carrier 130 in the assembled state comprises the bottom section 138 arranged opposite (radially on the inside) the uptake openings 114. This bottom section passes into or surrounds an inclined cover section 140. The cover section 140 serves in particular to enable a manufacturing by selective laser melting. In the inclined cover section 140, a plurality of openings 142 are provided. These openings 142 likewise serve to enable a manufacturing by selective laser melting. Hence, the seal carrier 130 is designed such in terms of its configuration that it can be produced by an additive manufacturing process, especially by selective laser melting.

What is common to both embodiments is that recesses 16, 116 are provided in the base section 12, 112, which serve to reduce the cording effect at the positioning element 10, 110. In particular, the recesses act to provide interruptions so that a radial temperature gradient cannot display its full effect along the entire circumference of the positioning element 10, 110. Moreover, the recesses serve to lessen the bending stiffness of the positioning element, which likewise reduces the cording effect.

It would be appreciated by those skilled in the art that various changes and modifications can be made to the illustrated embodiments without departing from the spirit of the present invention. All such modifications and changes are intended to be covered by the appended claims.

What is claimed is:

1. A positioning element for a guide vane arrangement of a guide vane stage of a gas turbine, comprising:

at least one base section curved in a peripheral direction;

a plurality of uptake openings arranged next to each other in the peripheral direction on the base section, whose aperture axes run substantially in a radial direction and which are designed to take up a respective radially inner guide vane section;

a coupling section provided on the base section, the coupling section is configured to be coupled to a seal carrier of a seal arrangement;

wherein a plurality of recesses are provided in the base section, each recess of the plurality of recesses being formed as a slot having a rectangular prism shape, and a respective one of the plurality of recesses is arranged between two respective neighboring uptake openings and runs through a radially inner face of the base section towards an outside of the base section at least in the radial direction, such that the plurality of recesses do not cut through the entirety of the base section.

2. The positioning element according to claim 1, wherein the positioning element is ring-shaped and comprises two semicircular base sections.

3. The positioning element according to claim 1, wherein the coupling section includes at least one axially front groove and one axially rear groove, which run on the base section along the peripheral direction.

4. The positioning element according to claim 3, wherein the axially front groove and the axially rear groove have substantially the same distance in the radial direction from a radially inner side of the base section.

5. The positioning element according to claim 3, wherein the axially front groove and the axially rear groove have a different distance from a radial inner side of the base section.

6. The positioning element according to claim 1, wherein each respective one of the plurality of recesses run in an axial direction between two respective uptake openings of the plurality of uptake openings.

7. The positioning element according to claim 6, wherein the plurality of recesses have a varying radial height along the axial direction, or has a uniform height.

8. The positioning element according to claim 6, wherein the plurality of recesses have a varying width along the axial direction in the peripheral direction, or has a uniform width.

9. The positioning element according to claim 1, wherein the plurality of recesses run in a peripheral direction in an axially rear region of the base section, so that from an axially rear view, substantially cylindrically shaped outer walls of the uptake openings are visible.

10. The positioning element according to claim 1, wherein the plurality of recesses are bounded in the axial direction by an axially front wall section.

11. The positioning element according to claim 1, wherein the positioning element is configured in a guide vane carrier arrangement.

* * * * *